US005984214A

United States Patent [19]

Nakayama et al.

[11] Patent Number: 5,984,214

[45] Date of Patent: Nov. 16, 1999

[54] MULTIAXES ROLL TYPE OF CRUSHER

[75] Inventors: Hiroshi Nakayama, Urayasu; Teruji Watajima, Takeo, both of Japan

[73] Assignee: Nakayama Iron Works LTD., Takeo, Japan

[21] Appl. No.: 08/910,250

[22] Filed: Aug. 13, 1997

[30] Foreign Application Priority Data

| | | | |
|---|---|---|---|
| Mar. 12, 1997 | [JP] | Japan | 9-076646 |
| May 19, 1997 | [JP] | Japan | 9-144763 |

[51] Int. Cl.[6] ..... B02C 4/08

[52] U.S. Cl. ..... 241/29; 241/159; 241/236

[58] Field of Search ..... 241/235, 236, 241/159, 29

[56] References Cited

U.S. PATENT DOCUMENTS

| | | | |
|---|---|---|---|
| 1,847,859 | 3/1932 | Beaumont . | |
| 2,366,619 | 1/1945 | Harrison | 241/159 |
| 2,879,950 | 3/1959 | Pollitz | 241/159 |
| 3,502,276 | 3/1970 | Panning et al. | 241/159 |
| 3,656,697 | 4/1972 | Nelson | 241/236 |
| 4,230,282 | 10/1980 | Haase | 241/159 |
| 4,374,573 | 2/1983 | Rouse et al. | 241/236 |
| 4,607,800 | 8/1986 | Barclay | 241/236 |

FOREIGN PATENT DOCUMENTS

| | | | |
|---|---|---|---|
| 479 687 | 1/1976 | Australia . | |
| 353 750 | 9/1905 | France . | |
| 14 021 | 8/1980 | Germany . | |
| 3234485 | 3/1984 | Germany | 241/236 |
| 1-284341 | 11/1989 | Japan . | |
| 1360790 | 12/1987 | U.S.S.R. | 241/236 |
| 1581377 | 7/1990 | U.S.S.R. | 241/236 |
| 19235 | 7/1912 | United Kingdom . | |
| 576 326 | 3/1946 | United Kingdom . | |

OTHER PUBLICATIONS

Patent Abstracts of Japan; vol. 014, No. 057 (C–0684), Feb. 2, 1990 & JP 01 284341A (Nippon Cement Co Ltd), Nov. 15, 1989.

*Primary Examiner*—Mark Rosenbaum
*Attorney, Agent, or Firm*—Armstrong, Westerman, Hattori, McLeland & Naughton

[57] ABSTRACT

A multiaxes roll type of crusher comprises four rolls. The four rolls respectively have teeth for directly crushing materials. There would be virtually 6 pairs of rolls in mathematically. There are really at least three relations given for crushing. Raw materials are crushed with a first crushing-relation to be of smaller size. Such crushed materials are secondly crushed with a second crushing-relation and a third crushing-relation to be of still smaller size. The first roll and the second roll can rotate in reversely opposite directions. The third roll and the fourth roll can rotate in reversely opposite directions. The reverse rotations cancel the crushing-relations. The flow of the crushed materials are controlled by a flow controlling means, which opens and closes the path between the third roll and the fourth roll. The opened flow controlling means does not obstruct the flow of foreign materials between the third roll and the fourth roll.

7 Claims, 10 Drawing Sheets

MULTIAXES ROLL TYPE OF CRUSHER

FIELD OF THE INVENTION

The present invention relates to a multiaxes roll type of crusher, and in particular relates to a multiaxes roll type of crusher for efficiently crushing hard raw materials such as stone or concrete.

BACKGROUND OF THE INVENTION 2-axes roll types of crushers for crushing raw stones are known. One 2-axes roll type of crusher has one pair of rolls. The rolls have the respective teeth on the respective cylindrical surfaces thereof. Stones are crushed between the teeth of the roll on the one side and the teeth on the other side, both sets of teeth being continually oncoming during the rotation.

Also known are 4-axes roll types of crushers, each of which has two pairs of rolls. Stones are crushed by one pair of rolls to be of smaller size. Such crushed stones are further crushed by the other pair of rolls to be of still smaller size. Such a known crusher has only two crushing relations, those being the one crushing-relation of one pair of rolls and the other crushing-relation of the other pair of rolls.

Nowadays, roll types of crushers are frequently utilized at construction sites where materials such as concrete are crushed to be recycled. Such materials often include heterogeneous materials such as iron.

It is more desirable that there are crushing-relations among four rolls rather than two crushing-relations so that the crushing efficiency is higher. It is further desirable that foreign materials are smoothly removed without the machines being stopped.

SUMMARY OF THE INVENTION

An object of the present invention is to provide a multiaxes roll type of crusher which has a high crush efficiency.

Another object of the present invention is to provide a multiaxes roll type of crusher which can crush twice the conventional amount of raw materials per unit time.

A further object of the present invention is to provide a multiaxes roll type of crusher which can crush more than twice the conventional amount of raw materials per unit time.

A still further object of the present invention is to provide a multiaxes roll type of crusher which has a high crushing efficiency, and facilitates discharging heterogeneous materials.

A multiaxes roll type of crusher comprises four rolls. Each of the four rolls respectively has teeth for directly crushing materials. Materials are introduced or inserted between a pairs of rolls. There would be virtually 6 pairs of rolls mathematically. One pair of rolls includes two rolls. At least 3 pairs are actually used by the crusher. That is, there are 3 crushing-relations given. The respective pairs correspond to the respective relations where materials can be crushed. Such relations are called crushing-relations in the specification. There are at least 3 crushing-relations given for a crusher according to the present invention.

The first crushing-relation is the relation of the first roll to the second roll. The second crushing-relation is the relation of the first roll to the third roll. The third crushing-relation is the relation of the second roll to the fourth roll. Raw materials such as stones, concrete, asphalt and so on are crushed to a smaller size in diameter with the first crushing-relation. That is, raw materials are crushed between the first roll and the second roll. The crushed materials crushed in the first crushing-relation, which are named the first crushed materials, are secondly crushed in the second crushing-relation or the third crushing-relation between the first roll and the third roll or between the second roll and the fourth roll.

The secondly crushed materials, which are named the second crushed materials, are still smaller in size of diameter than the first crushed materials. The first crushing-relation has the first roll rotating in the counterclockwise direction, while the second roll rotates in the clockwise direction. The second crushing-relation has the first roll rotating in the counterclockwise direction, while the third roll rotates in the clockwise direction. The third crushing-relation is in that the second roll rotates in the clockwise direction, while the fourth roll rotates in the counterclockwise direction. The first roll and the second roll rotate in opposite directions and in reversely opposite directions. The third roll and the fourth roll rotate in opposite directions and in reversely opposite directions.

The second roll is located relative to the first roll so that raw materials are crushed between the first roll and the second roll. The third roll is located relative to the first roll so that the first crushed materials are crushed between the first roll and the third roll. The fourth roll is located relative to the second roll so that the first crushed materials are crushed between the second roll and the fourth roll.

Such locations are defined as follows. The cylindrical surface which includes the locus of rotation of the outer end of the first crushing teeth does not overlap with the cylindrical surface including the locus of rotation of the outer end of the second crushing teeth, while the cylindrical surface including the locus of rotation of the outer end of the first crushing teeth overlaps with the cylindrical surface including the locus of rotation of the outer end of the third crushing teeth, and the cylindrical surface including the locus of rotation of the outer end of the second crushing teeth overlaps with the cylindrical surface including the locus of rotation of the outer end of the fourth crushing teeth.

One pair of rolls, those of the first roll and the second roll, may simultaneously rotate in the respective reverse directions. Another pair of rolls, those of the first roll and the third roll, may simultaneously rotate in the respective reverse directions. The further pair of rolls, those of the second roll and the fourth roll, may simultaneously rotate in the respective reverse directions. It is desirable that one roll may rotate in the clockwise direction and in the counterclockwise direction independently of the other rolls.

A multiaxes roll type of crusher further comprises a controlling means. The controlling means may be located among the four rolls or may be located between the third roll and the fourth roll. It is desirable that the controlling means is located under the plane including the center line of the rotating axis of the third roll and the center line of the rotating axis of the fourth roll. The controlling means is movable in the upward direction and in the downward direction. The fluid of the second crushed materials are restricted by the controlling means, which moves in the upward direction and is at rest in the bottom position. Under the condition of restriction, the first crushed materials are secondly and effectively crushed. The controlling means at the top position facilitates the flow of the first crushed materials so that they are led between the first roll and the third roll, and led between the second roll and the fourth roll. With heterogeneous or alloyed materials such as iron, the controlling means retracts in the downward direction. Under the condition of retraction, the first crushing-relation, the second crushing-relation and the third crushing-relation are simultaneously cancelled.

DETAILED DESCRIPTION OF THE PREFERRED EMBODIMENTS

Figure 1:
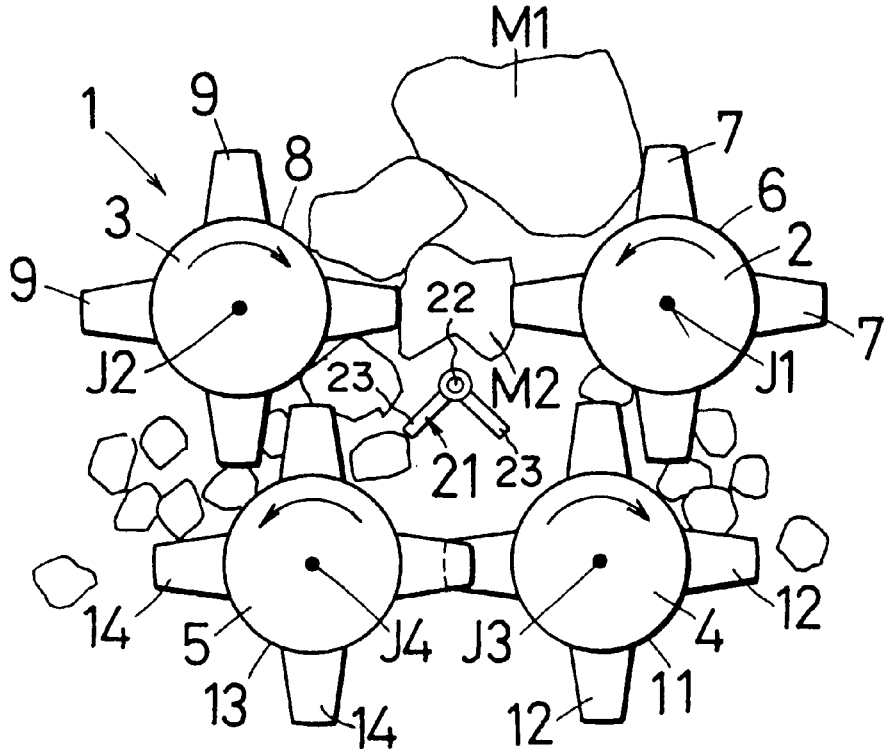
FIG. 1 is a front view showing a first embodiment of a multiaxes roll type of crusher according to the present invention.

FIG. 1 illustrates an embodiment of a multiaxes roll type of crusher according to the present invention. The crusher comprises four rolls. The first crushing teeth 7 are provided with a first roll 2. The first rotating center line J1 of the rotating axis of first roll 2 is abstractly denoted by a point. The second crushing teeth 9 are provided with a second roll 3. The second rotating center line J2 of the rotating axis of second roll 3 is abstractly denoted by a point. The third crushing teeth 12 are provided with a third roll 4. The third rotating center line J3 of the rotating axis of third roll 4 is abstractly denoted by a point. The fourth crushing teeth 14 are provided with a fourth roll 5. The fourth rotating center line J4 of the rotating axis of fourth roll 5 is abstractly denoted by a point.

The first, second, third and fourth rotating center lines J1,J2,J3 and J4 are substantially or generally parallel with one another. The first and second rotating center lines J1,J2 are desirably contained on one horizontal plane. The third and fourth rotating center lines are desirably included in another horizontal plane.

First roll 2 comprises a first rotating drum 6. First crushing teeth 7 are fixed with first rotating drum 6. First crushing teeth 7 respectively protrude from the cylindrical surface of first rotating drum 6 in the radial direction. A first quartet of teeth are positioned at the equal intervals in the circumferential direction. Second roll 3 comprises a second rotating drum 8. Second crushing teeth 9 are fixed with second rotating drum 8. Second crushing teeth 9 respectively protrude from the cylindrical surface of second rotating drum 8 in the radial direction. A second quartet of second crushing teeth 9 are positioned at equal intervals in the circumferential direction. Third roll 4 comprises a third rotating drum 11. Third crushing teeth 12 are fixed with third rotating drum 11. Third crushing teeth 12 respectively protrude from the cylindrical surface of third rotating drum 11 in the radial direction. A third quartet of teeth are positioned at the equal intervals in the circumferential direction. Fourth roll 5 comprises a fourth rotating drum 13. Fourth crushing teeth 14 are fixed with fourth rotating drum 13. Fourth crushing teeth 14 respectively protrude from the cylindrical surface of fourth rotating drum 13 in the radial direction. A fourth quartet of teeth are positioned at equal intervals in the circumferential direction.

The respective sets of teeth are positioned on the respective surfaces of the respective drums, and line up in the respective axial directions. The second set of second crushing teeth 9 lining in the axial direction have the respective differences of 180 degrees in phases with respect to the first set of first crushing teeth 7 lining in the axial direction. The third set of third crushing teeth 12 lining in the axial direction have respective differences of 180 degrees in phases with respect to the first set of first crushing teeth 7 lining in the axial direction. The fourth set of fourth crushing teeth 14 lining in the axial direction have respective differences of 180 degrees in phases with respect to the third set of second crushing teeth 9 lining in the axial direction.

The four rolls may not be equal in size. The position of first rotating center line J1 is equal in height to the position of second rotating center line J2. The position of third rotating center line J3 is equal in height to the position of fourth rotating center line J4. The position of first rotating center line J1 is higher than the position of fourth rotating center line J4. The distance between first rotating center line J1 and second rotating center line J2 is longer than the distance between third rotating center line J3 and fourth rotating center line J4.

There is a first crushing-relation between first roll 2 and second roll 3, in that first roll 2 rotates in the counterclockwise direction while second roll 3 rotates in the clockwise direction. There is a second crushing-relation between first roll 2 and third roll 4, in that first roll 2 rotates in the counterclockwise direction while third roll 4 rotates in the clockwise direction. There is a third crushing-relation between second roll 3 and fourth roll 5, in that second roll 3 rotates in the clockwise direction, while fourth roll 5 rotates in the counterclockwise direction. There may be or may not be a fourth crushing-relation between third roll 4 and fourth roll 5, in that third roll 2 rotates in the clockwise direction, while fourth roll 5 rotates in the counterclockwise direction.

The first cylindrical surface including the locus of rotation of the outer end of first crushing teeth 7 does not overlap with the second cylindrical surface including the locus of rotation of the outer end of second crushing teeth 9. The first cylindrical surface including the locus of rotation of the outer end of first crushing teeth 7 overlaps with the third cylindrical surface including the locus of rotation of the outer end of third crushing teeth 12. The cylindrical surface including the locus of rotation of the outer end of second crushing teeth 9 overlaps with the fourth cylindrical surface including the locus of rotation of the outer end of fourth crushing teeth 14. Raw materials are crushed in the first crushing-relation to be made of smaller size. The first crushed materials crushed between first roll 2 and second roll 3 are secondly crushed in the second crushing-relation between first roll 2 and third roll 4 to be made yet smaller in size than the first crushed materials. Also, the first crushed materials are secondly crushed in the third crushing-relation between second roll 3 and fourth roll 5 to be made still smaller in size than the first crushed materials. It is possible that one more crushing-relation is given between third roll 4 and fourth roll 5.

Figure 2:
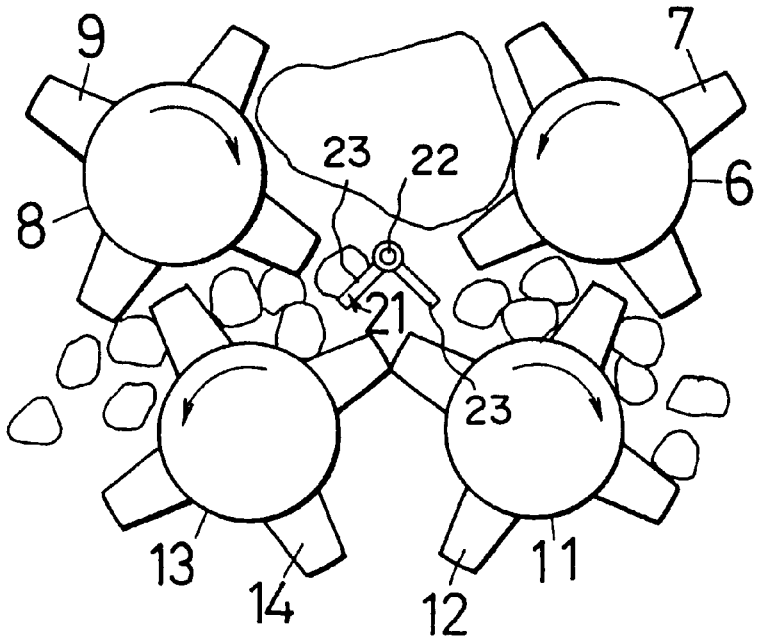
FIG. 2 is a front view showing another position of rotation of the rolls of the embodiment.
Figure 3:
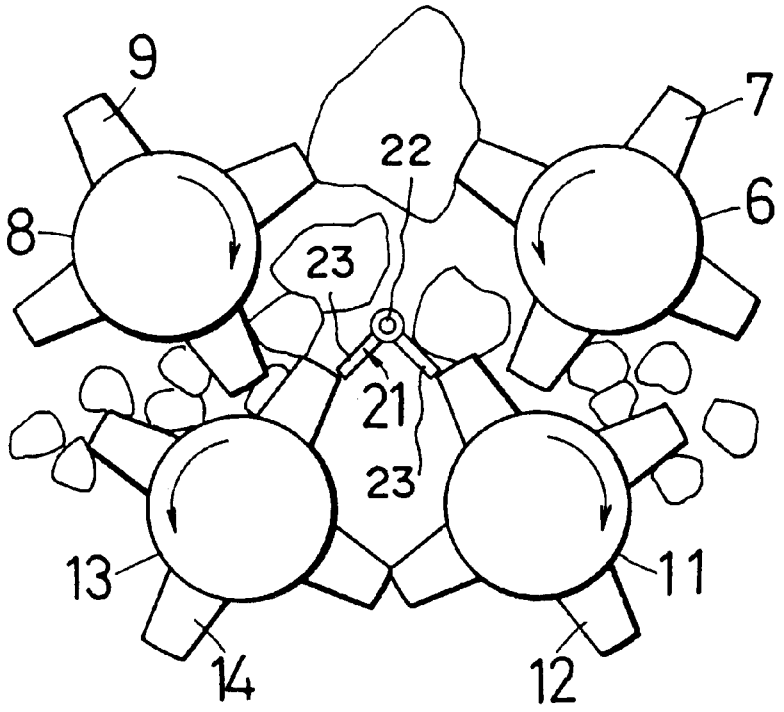
FIG. 3 is a front view showing a further different position of rotation of the rolls of the embodiment.

FIG. 2 illustrates one state in that the respective rolls 2,3,4,5 advance in the respective phases of 30 degrees with respect to the rolls shown in FIG. 1. FIG. 3 illustrates another state in that the respective rolls 2,3,4,5 further advance in the respective phases of 30 degrees with respect to the rolls shown in FIG. 2. As illustrated in FIGS. 1,2,3, the four rolls synchronously rotate.

FIG. 1 illustrates a fluid controlling means 21 for controlling the fluid produced between the four rolls. The fluid controlling means 21 includes a supporting axis 22 and a pair of wings 23. Wings 23 are supported by supporting axis 22. Pair of wings 23 opens or closes the fluid passage formed between third roll 4 and fourth roll 5. The first fluid of the first crushed materials is not restricted by opened fluid controlling means 21. The first fluid from the space between first roll 2 and second roll 3 towards the space between third roll 4 and fourth roll 5 is restricted by closed fluid controlling means 21. Being closed, fluid controlling means 21 facilitates the second fluid from the space between first roll 2 and second roll 3 towards the space between first roll 2 and third roll 4, and fluid controlling means 21 facilitates the third fluid from the space seen first roll 2 and second roll 3 towards the space between second roll 3 and fourth roll 5.

Figure 4:
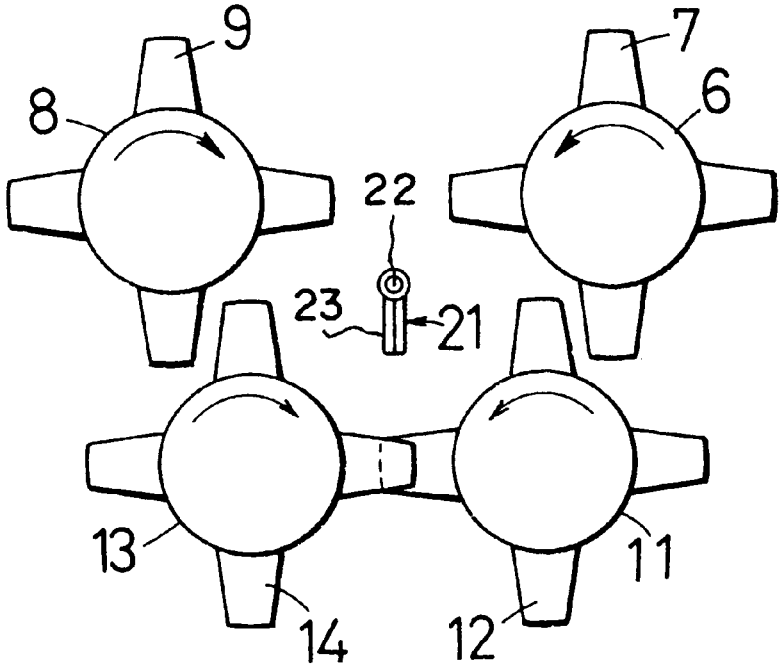
FIG. 4 is a front view showing another state of operation of the embodiment.

FIG. 4 illustrates a method for controlling fluids. First roll 2 rotates in the counterclockwise direction, while second roll 3 rotates in the clockwise direction. There is a crushing-relation between first roll 2 and second roll 3. Third roll 4 rotates in the counterclockwise direction, while fourth roll 5 rotates in the clockwise direction. There is no crushing-relation between first roll 2 and third roll 4, and there is no crushing-relation between second roll 3 and fourth roll 5. That is, the second and third crushing-relations are cancelled by the reverse of the respective rotations of the third roll and the fourth roll. Being opened, fluid controlling means 21 facilitates the first fluid from the space between first roll 2 and second roll 3 towards the space between third roll 4 and fourth roll 5.

The above mentioned overlappings of two pairs of rolls facilitate making the second crushed materials smaller in size than the first crushed materials. In general, the shorter the distance between a pair of rolls, the smaller the materials are crushed in size. In other words, the shorter the distance between a pair of drums of a pair of rolls, the smaller the materials are crushed in size.

The quantity of materials to be crushed by a 4-axes crusher according to the present invention is defined by twice the quantity of materials to be crushed between first roll 2 and third roll 4. This means that a crusher according to the present invention corresponds in crushing capacity to the three 2-axes crushers of the conventional type.

Figure 5:
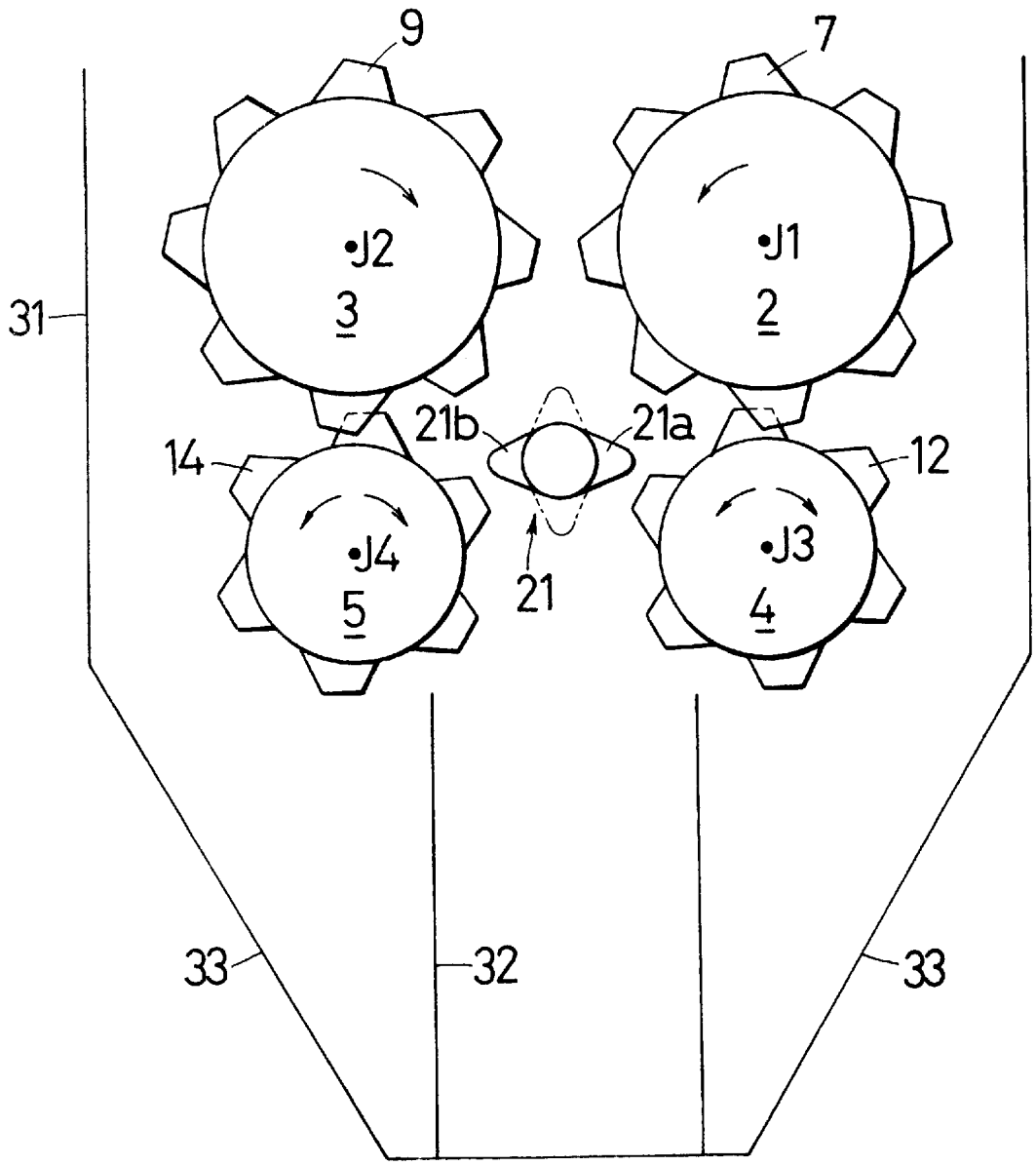
FIG. 5 if a front view showing an improved fluid controlling body.

FIG. 5 illustrates a second embodiment of a 4-axes roll type of crusher according to the present invention. This embodiment is not different from the first embodiment in respect to the fact that a second crusher according to the second embodiment comprises 4 rolls, and there are three crushing-relations given thereto. The first, second, third and fourth rotating center lines J1,J2,J3,J4 pass four apexes of a rectangle. The distance between first rotating center line J1 and second rotating center line J2 is equal to the distance between third rotating center line J3 and fourth rotating center line J4. The distance between first rotating center line J1 and third rotating center line J3 is equal to the distance between second rotating center line J2 and fourth rotating center line J4. The distance between first rotating center line J1 and second rotating center line J2 is longer than the distance between first rotating center line J1 and third rotating center line J3. The diameter of the first cylindrical surface including the locus of rotation of the outer end of first crushing teeth 7 is equal to the diameter of the second cylindrical surface including the locus of rotation of the outer end of second crushing teeth 9, but the diameter of the first cylindrical surface including the locus of rotation of the outer end of first crushing teeth 7 is longer than the diameter of the third cylindrical surface including the locus of rotation of the outer end of third crushing teeth 12. Second roll 3 is not different in size from first roll 2. Fourth roll 5 is not different in size from third roll 4. Fourth roll 5 is smaller in size than first roll 2.

The first crushed materials crushed between first roll 2 and second roll 3 are secondly crushed smaller in size in the second embodiment than in the first embodiment. FIG. 5 illustrates a revision of fluid controlling means 21. The revision comprises a pair of fluid controlling protrusions 21*a* and 21*b* positioned on one diameter line. Pair of fluid controlling protrusions 21*a*, 21*b* rotates by 90 degrees to open the path between third roll 4 and fourth roll 5 so that heterogeneous materials such as iron can pass through the path.

The four rolls are located on the inside of a casing 31. A products container 33 and a foreign materials container 32 are formed by casing 31. The second crushed materials between first roll 2 and third roll 4 or between second roll 3 and fourth roll 5 are led into products container 33 when fluid controlling means 21 is closed, and the foreign materials pass without obstruction by the pair of fluid controlling protrusions 21*a*, being led into foreign materials container 32 when fluid controlling means 21 is opened.

Figure 6:
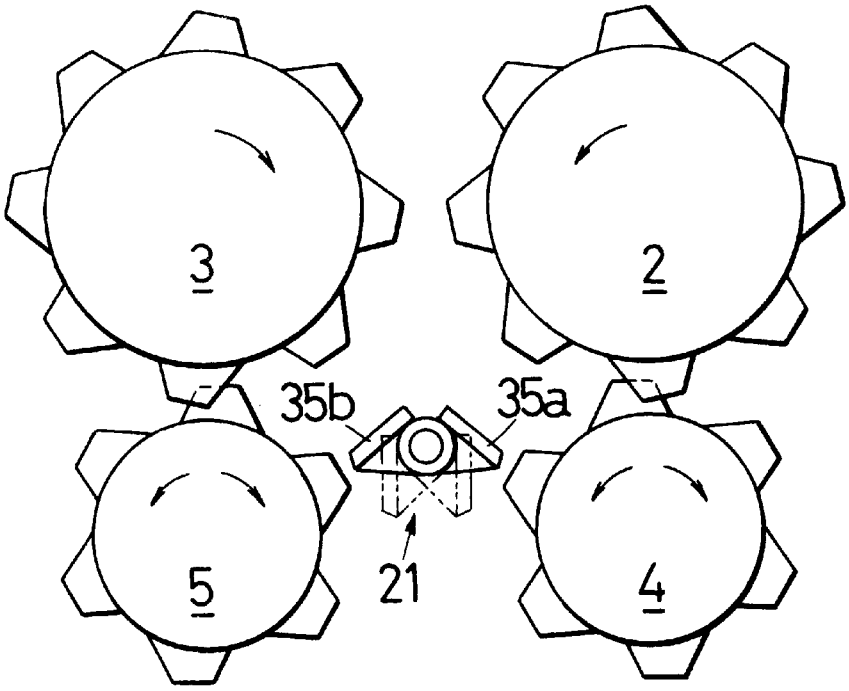
FIG. 6 is a front view showing a further improved fluid controlling body.

FIG. 6 illustrates another revision of fluid controlling means 21. The fluid controlling means 21 comprises a pair of two rotatable plates 35*a*, 35*b*. Two rotatable plates respectively rotate by 45 degrees in opposite directions respectively.

Figure 7:
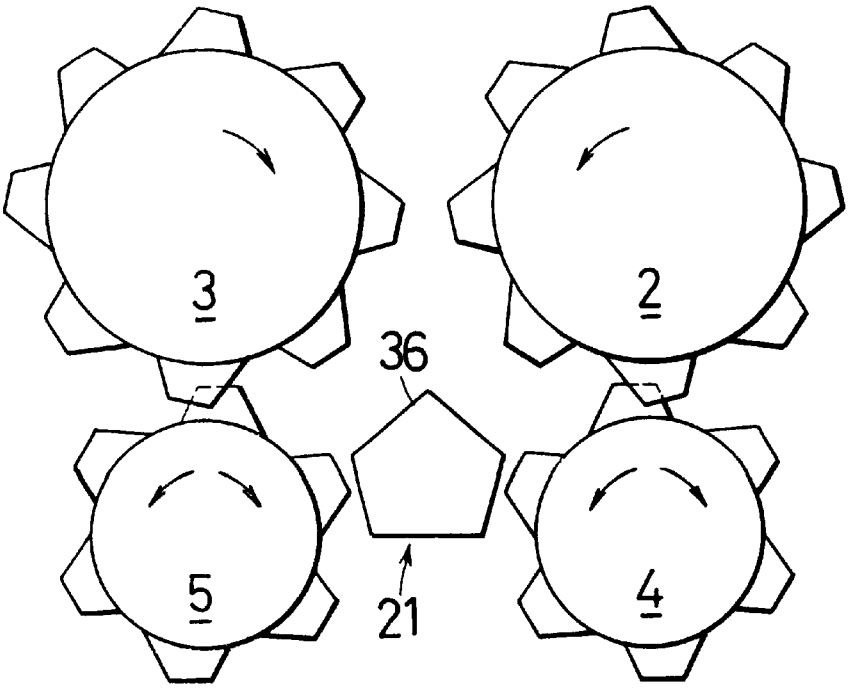
FIG. 7 is a front view showing a further improved fluid controlling body.

FIG. 7 illustrates a further revision of fluid controlling means 21. The fluid controlling means 21 comprises single rod 36, which is formed pentagonally in sectional form. Single rod 36 advances and retracts in the axial direction. Advancing single rod 36 appears into the space among the rolls, while retracting rod 36 disappears from the space.

Figure 8:
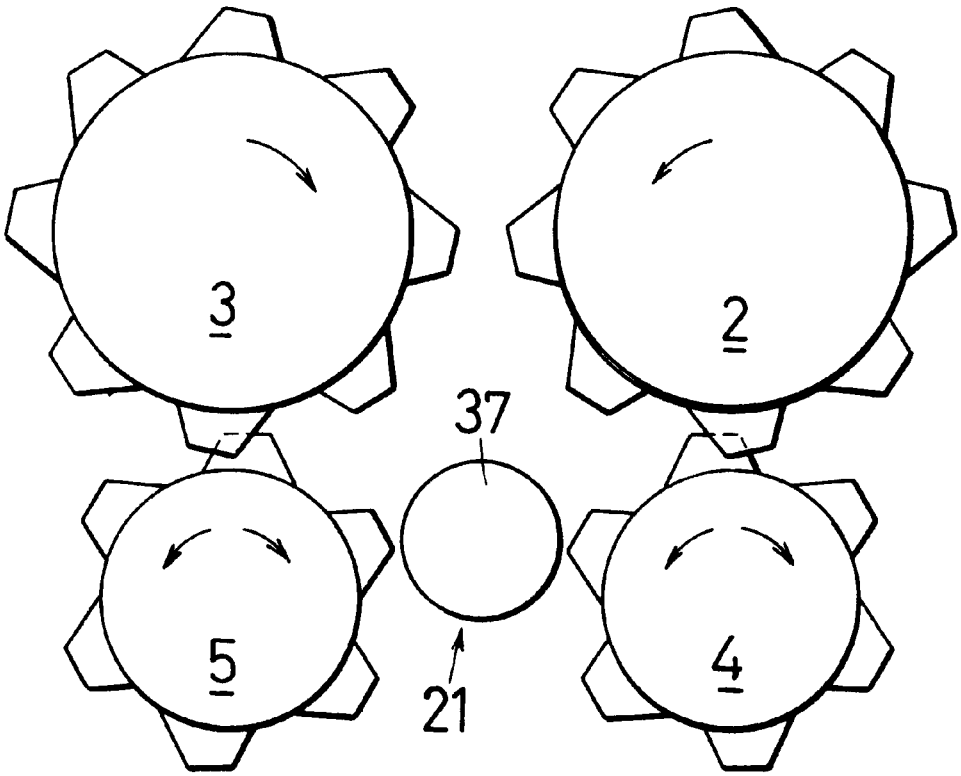
FIG. 8 is a front view showing a further improved fluid controlling body.

FIG. 8 illustrates a further revision of fluid controlling means 21. The fluid controlling means 21 comprises single column 37. Single column 37 advances and retracts in the axial direction. Advancing single column 37 appears into the space among the rolls, while retracting column 37 disappears from the space. Column 37 may be made of a pipe.

Figure 9:
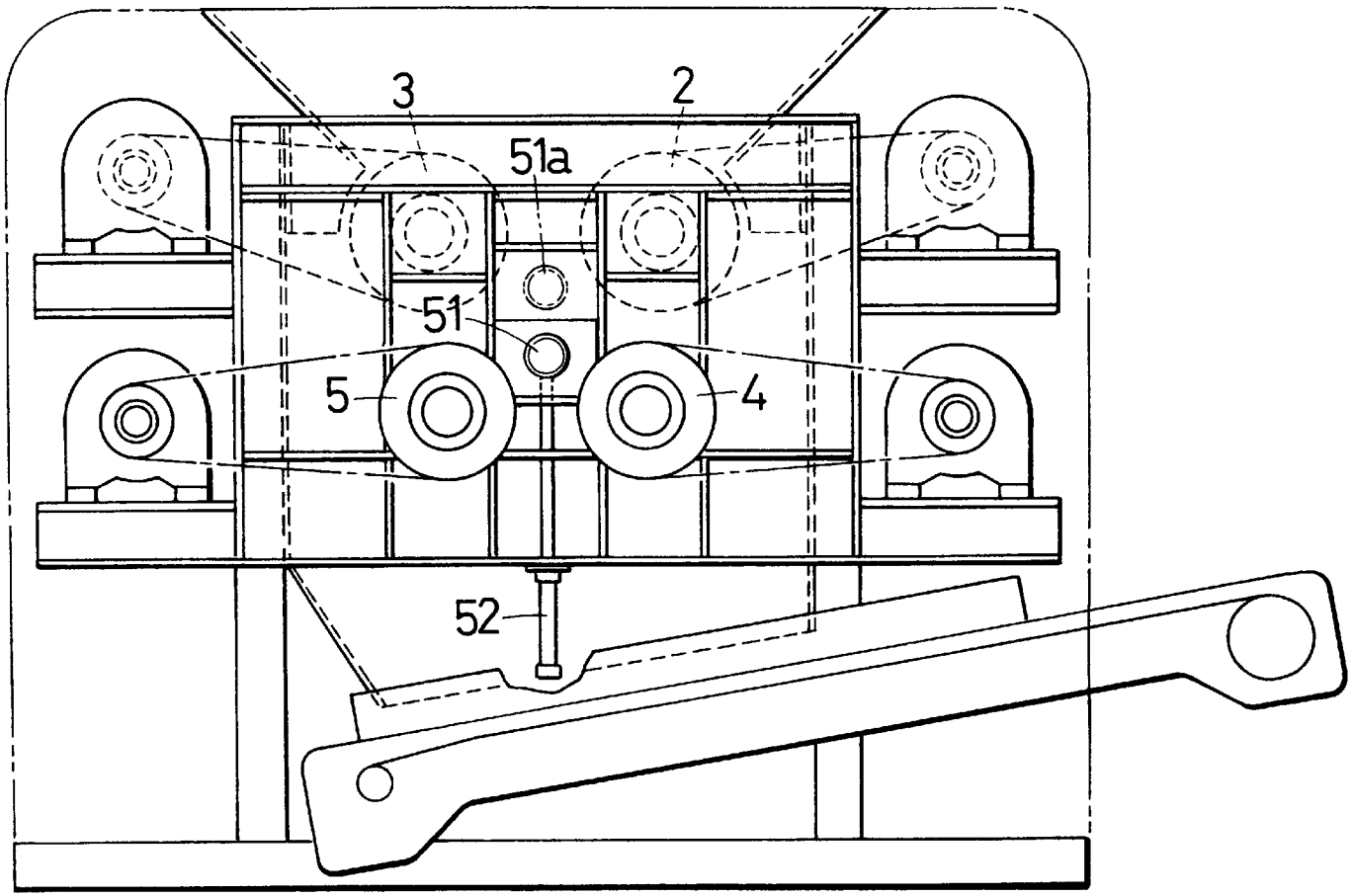
FIG. 9 is a front view showing a driving system for driving the rolls of FIG. 1.

FIG. 9 illustrates a further revision of fluid controlling means 21. The fluid controlling means 21 comprises single elevating pipe 51. Single elevating pipe 51 is located among the four rolls. Single elevating pipe 51 is supported and driven by a driving cylinder 52. Single elevating pipe 51 moves in the upward direction and in the downward direction. Single elevating pipe 5 la at the upper portion opens the path formed between third roll 4 and fourth roll 5, while single elevating pipe 51 at the lower portion closes the path formed between third roll 4 and fourth roll 5. Single elevating pipe 51*a* at the upper portion does not prevent the flow of foreign materials passing between third roll 4 and fourth roll 5.

Both first roll 2 and second roll 3 are respectively (simultaneously) and reversely driven when the load of first roll 2 and second roll 3 is excessive. It is desirable that both third roll 4 and fourth roll 5 are respectively (simultaneously) and reversely driven when the load is excessive. Both first roll 2 and third roll 4 are respectively (simultaneously) and reversely driven when the load of first roll 2 and third roll 4 is excessive. It is desirable that both second roll 3 and fourth roll 5 are respectively (simultaneously) and reversely driven when the load is excessive. Such reverse rotation together with the driving of fluid controlling means 21 soon facilitates the cancellation of the obstruction of the flow(s).

Figure 10:
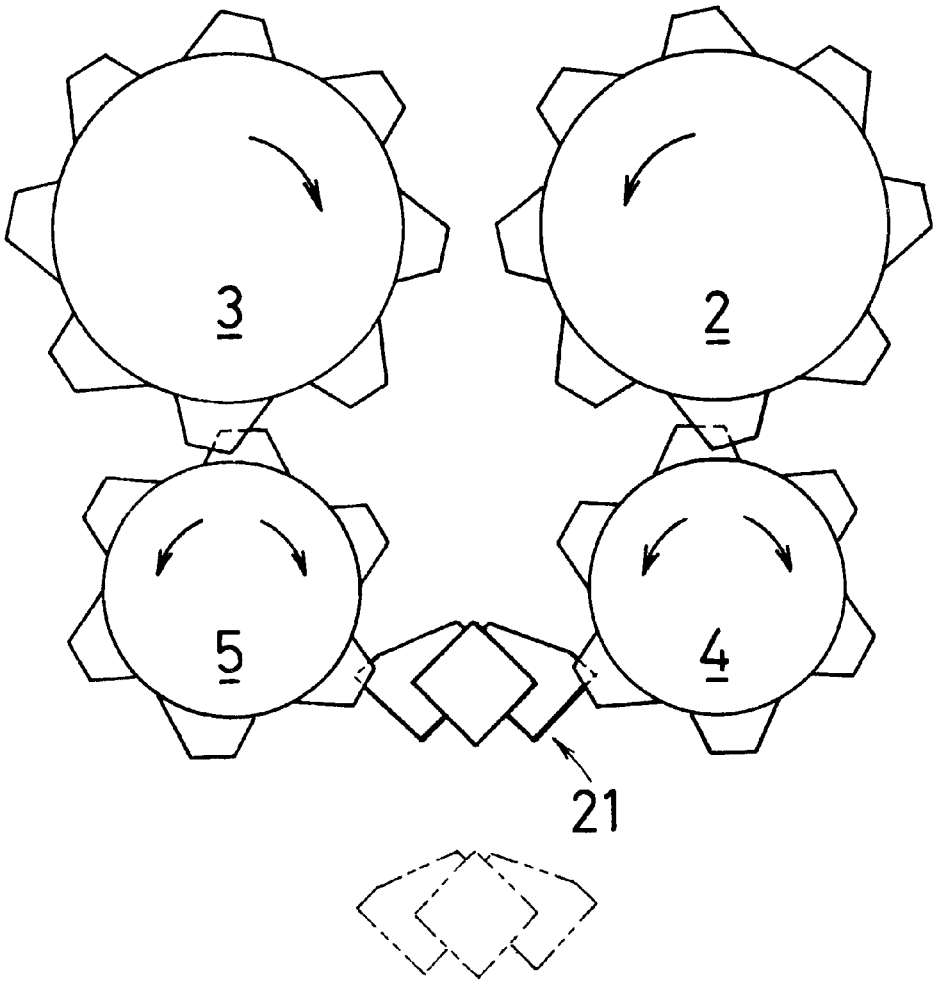
FIG. 10 is a front view showing a further improved fluid controlling body.

FIG. 10 illustrates an effective revision of fluid controlling means 21. This revision is not different from the above mentioned embodiments or revisions illustrated in FIGS. 1,5,6,7,8, and 9. The three crushing-relations are not different from the above mentioned crushing-relations. Further this revision is not different from the above revisions in respect to the fact that the first flow is divided by fluid controlling means 21 into the second flow and the third flow. That is, fluid controlling means 21 of the above mentioned revisions is located on the inside of the space among the four rolls.

However, the first flow is not divided directly by fluid trolling means 21 in the revision shown in FIG. 10. As shown in FIG. 10, fluid controlling means 21 is located on the outside of the space among the four rolls. Fluid controlling means 21 is located under the plane that includes third rotating center line J3 and fourth rotating center line J4. Fluid controlling means 21 moves in the upward direction and in the downward direction. Fluid controlling means 21 at the lower position perfectly opens the space between third roll 4 and fourth roll 5.

Figure 11:
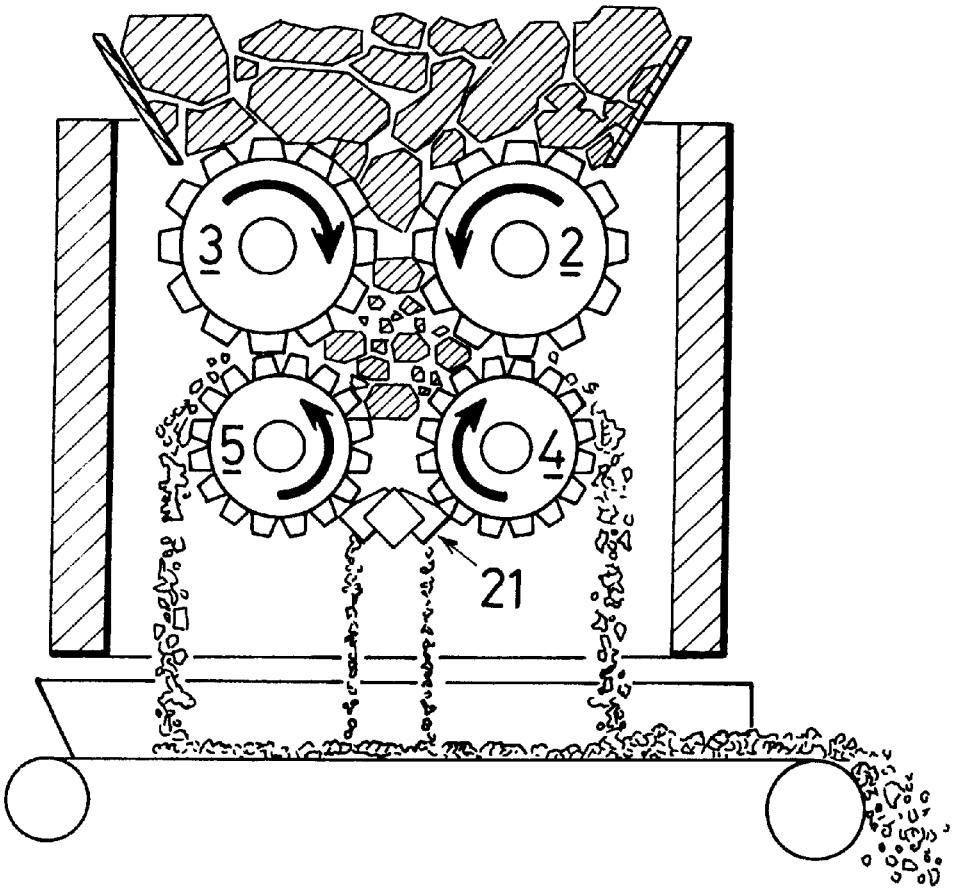
FIG. 11 is a front sectional view showing one condition of crushing according to the embodiment of FIG. 1.
Figure 12:
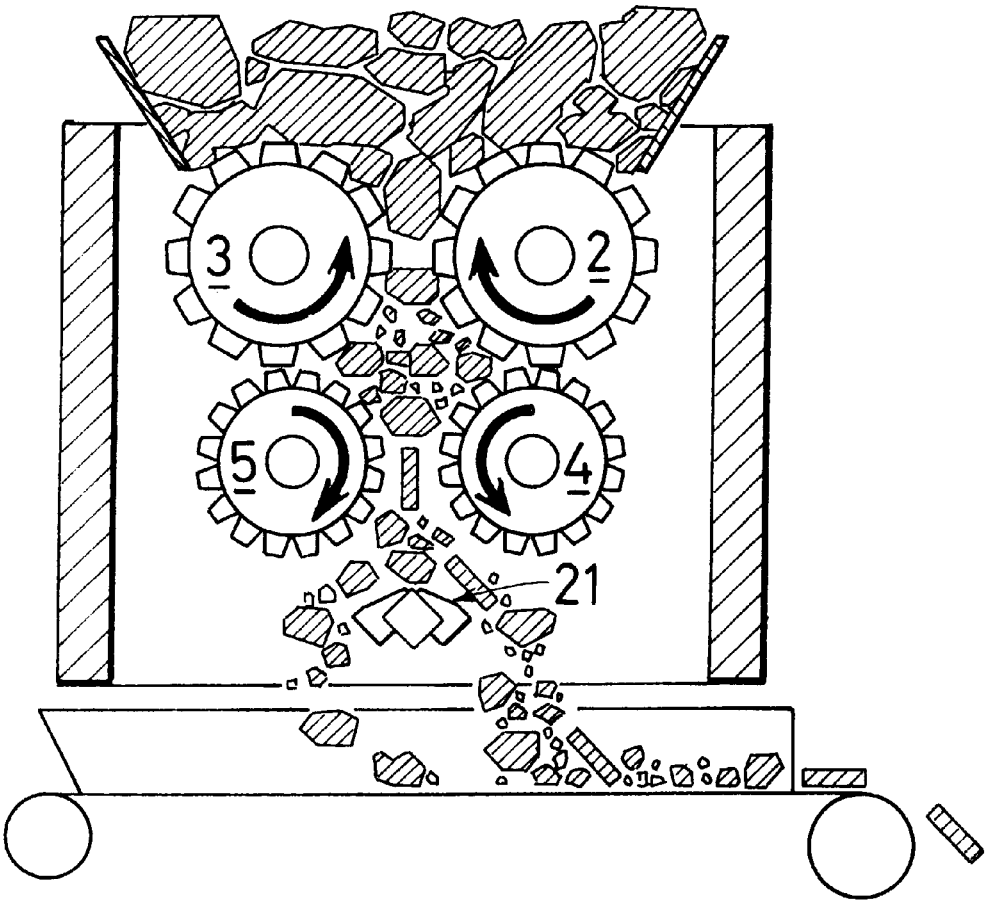
FIG. 12 is a front sectional view showing another condition of crushing according to the embodiment of FIG. 1.
Figure 13:
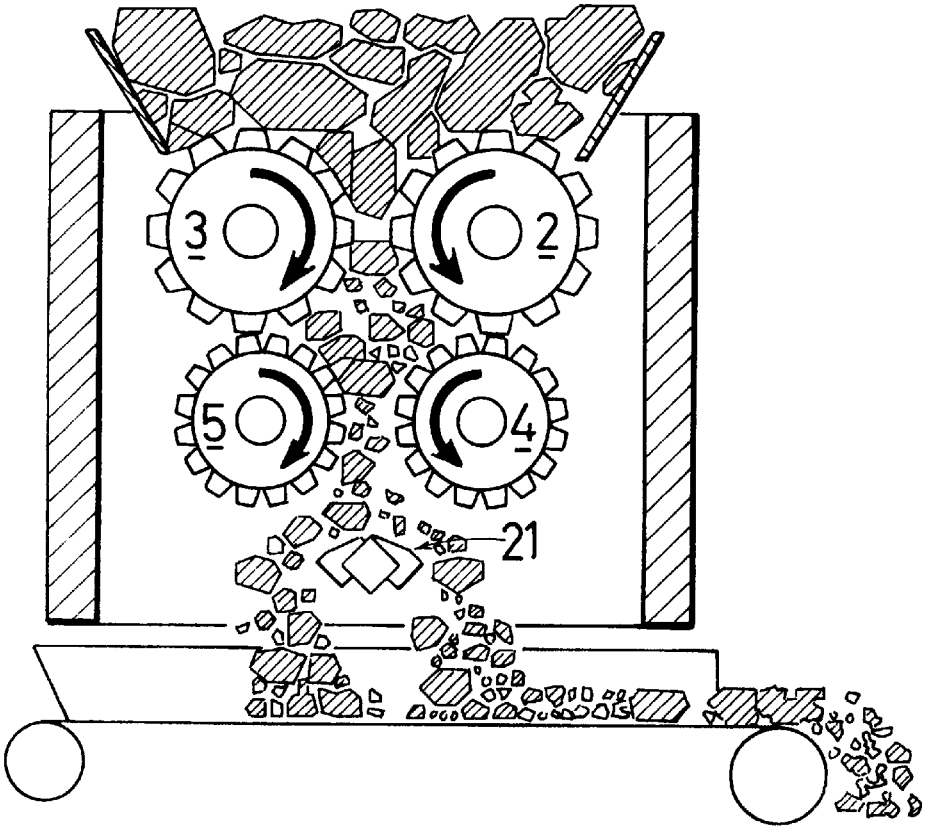
FIG. 13 is a front sectional view showing a further condition of crushing according to the embodiment of FIG. 1.

FIG. 11, FIG. 12 and FIG. 13 abstractly illustrate the flows obtained by an experiment according to the embodiment as illustrated in FIG. 10. FIG. 11 shows one condition of crushing where the crusher has the three crushing-relations, and the fluid between third roll 4 and fourth roll 5 is obstructed by fluid controlling means 21 at the upper position. The greater part of the second crushed materials pass through the path formed between second roll 3 and fourth roll 5 or the path formed between first roll 2 and third roll 4 to be discharged outside the respective spaces therebetween. The remaining part of the second crushed materials, which are smaller in size than the greater part pass through the narrower path formed between fluid controlling means 21 and third roll 4 or between fluid controlling means 21 and fourth roll 5.

FIG. 12 shows another condition of crushing where the crusher substantially has no crushing-relation, and the fluid between third roll 4 and fourth roll 5 is not obstructed by fluid controlling means 21 at the lower position. Under this condition, the small quantity of the first crushed materials and the foreign materials are discharged through the path formed between third roll 4 and fourth roll 5. Materials such as iron are magnetically detected by a detector (not shown). Upon detecting fluid controlling means 21 moves in the downward direction.

FIG. 13 shows the further condition of crushing where the first crushing-relation is not cancelled, but both second crushing-relation and third crushing-relation are cancelled. The first crushed materials are maintained in the size which they have when crushed between first roll 2 and second roll 3. Such crushed materials are discharged between third roll 4 and fourth roll 5 without obstruction of fluid controlling means 21.

What is claimed is:

1. A multiaxes roll type of crusher, comprising:

two pairs of rolls, each pair of said pairs including two rolls, each of said rolls having teeth for crushing raw materials, wherein there are at least three crushing-relations for crushing raw materials given among four rolls of said two pairs, and wherein two of said at least three crushing-relations comprise overlapping teeth among two pairs of rolls, while a remaining one of said at least three crushing-relations comprises non-overlapping teeth between a pair of rolls, said four rolls including a first roll having a multiple of first crushing teeth, a second roll having a multiple of second crushing teeth, a third roll having a multiple of third crushing teeth, a fourth roll having a multiple of fourth crushing teeth, said third roll being located under said first roll, said fourth roll being located under said second roll, said three crushing-relations including a first crushing-relation, a second crushin-grelation, and a third crushing-relation, said three crushing-relations having said second roll rotating in the clockwise direction with said third roll rotating in the clockwise direction, and with said fourth roll rotating in the counterclockwise direction, when said first roll rotates in the counterclockwise direction, wherein said respective third and fourth rolls reversely and simultaneously rotate; and a controlling means for controlling the fluid of crushed materials, said controlling means being movable so that said fluid is restricted between said third roll and said fourth roll.

2. A multiaxes roll type of crusher, comprising:

two pairs of rolls, each pair of said pairs including two rolls, each of said rolls having teeth for crushing raw materials, wherein there are at least three crushing-relations for crushing raw materials given among four rolls of said two pairs, and wherein two of said at least three crushing-relations comprise overlapping teeth among two pairs of rolls, while a remaining one of said at least three crushing-relations comprises non-overlapping teeth between a pair of rolls, said four rolls including a first roll having a multiple of first crushing teeth, a second roll having a multiple of second crushing teeth, a third roll having a multiple of third crushing teeth, a fourth roll having a multiple of fourth crushing teeth, said third roll being located under said first roll, said fourth roll being located under said second roll, said three crushing-relations including a first crushing-relation, a second crushingrelation, and a third crushing-relation, said three crushing-relations having said second roll rotating in the clockwise direction with said third roll rotating in the clockwise direction, and with said fourth roll rotating in the counterclockwise direction, when said first roll rotates in the counterclockwise direction; and a controlling means for controlling the fluid of crushed materials, said controlling means being located between said third roll and said fourth roll.

3. A multiaxes roll type of crusher of claim 2, wherein said controlling means moves so that said fluid is not restricted between said third roll and said fourth roll.

4. A multiaxes roll type of crusher comprising:

two pairs of rolls;

each pair of said pairs including two rolls, each of said rolls having teeth for crushing raw materials, wherein there are four crushing-relations given among four rolls of said two pairs for crushing raw materials, said four rolls including a first roll having a multiple of first crushing teeth, a second roll having a multiple of second crushing teeth, a third roll having a multiple of third crushing teeth, a fourth roll having a multiple of fourth crushing teeth, said third roll being located under said first roll, said fourth roll being located under said second roll, said three crushing-relations including a first crushing-relation, a second crushing-relation, a third crushing-relation, and fourth crushing-relation, said crushing-relation having said second roll rotating in the clockwise direction with said third roll rotating in the clockwise direction, and with said fourth roll rotating in the counterclockwise direction, when said first roll rotates in the counterclockwise direction, wherein said first crushing teeth and said third crushing teeth have an overlapping relationship, wherein said second crushing teeth and said fourth crushing teeth also have an overlapping relationship, and wherein said first crushing teeth and said second crushing teeth have a non-overlapping relationship;

a reverse means for rotating said pairs of rolls respectively in the reverse directions, and a controlling means for controlling the fluid of crushed materials, said controlling means being movably located between said third roll and said fourth roll so that said fluid is controlled at least between said third roll and said fourth roll.

5. A method for crushing raw materials, wherein a four-axes roll type of crusher is used, and said crusher comprises a first roll, a second roll, a third roll and a fourth roll, wherein each of said first, second, third and fourth rolls has a plurality of teeth, said method comprising the steps of:

first crushing for crushing raw materials between said first roll and said second roll, said teeth of said first and second rolls being in a non-overlapping relationship;

second crushing for crushing first crushed materials crushed by said first crushing; and third crushing for crushing said first crushed materials crushed by said first crushing, wherein second crushed materials crushed by said second crushing or said third crushing are smaller in size than said first crushed materials, wherein said teeth of said first and third rolls are in an overlapping relationship, and wherein said teeth of said second and fourth rolls are in an overlapping relationship; and controlling the fluid of said crushed materials by means of a controlling means located between two rolls of said rolls, said controlling including moving said controlling means.

6. A method for crushing raw materials of claim 5, wherein said controlling means is located between said third roll and said fourth roll.

7. A method for crushing raw materials of claim 6, further comprising driving for reversely rotating said respective rolls.

* * * * *